US005862699A

United States Patent [19]

Lestani et al.

[11] Patent Number: 5,862,699

[45] Date of Patent: Jan. 26, 1999

[54] METHOD FOR THE ROLLING OF LONG PRODUCTS AND ROLLING LINE WHICH PERFORMS THAT METHOD

[75] Inventors: Massimo Lestani, Sequals; Roberto Nini, Tricesimo, both of Italy

[73] Assignee: Danieli & C. Officine Meccaniche SpA, Italy

[21] Appl. No.: 784,263

[22] Filed: Jan. 15, 1997

[30] Foreign Application Priority Data

Feb. 12, 1996 [IT] Italy ..... UD96A0017

[51] Int. Cl.[6] ..... B21B 27/06; B21B 31/07

[52] U.S. Cl. ..... 72/201; 72/226; 72/238

[58] Field of Search ..... 72/221, 222, 200, 72/201, 202, 225, 226, 227, 228, 229, 238, 239, 234

[56] References Cited

U.S. PATENT DOCUMENTS

| | | | |
|---|---|---|---|
| 3,683,662 | 8/1972 | Dechene et al. | 72/235 |
| 4,528,834 | 7/1985 | Aoyagi et al. | 72/202 |
| 4,662,203 | 5/1987 | Kanatani et al. | 72/9 |
| 5,082,047 | 1/1992 | Bricmont | 72/202 |
| 5,129,250 | 7/1992 | Palma et al. | 72/234 |

FOREIGN PATENT DOCUMENTS

| | | |
|---|---|---|
| 264868A | 4/1988 | European Pat. Off. . |
| 358917A | 3/1990 | European Pat. Off. . |
| 432532A | 6/1991 | European Pat. Off. . |
| 560093A | 9/1993 | European Pat. Off. . |
| 603707A | 6/1994 | European Pat. Off. . |
| 606966A | 7/1994 | European Pat. Off. . |

OTHER PUBLICATIONS

Iron and Steel Engineer, vol. 69, No. 5, May 1992, pp. 13–17, M. Nobrega et al "World's fastest rod and bar mil at Belgo works, Brazil".

Draht, vol. 44, No. 12, Dec. 1993, Bamberg De, pp. 697–703, Hensel et al "Neue Erkenntnisse beim Walzen von Feinstahl und Draht auf einer modernisierten Edelstahlstrasse".

Steel Times International, vol. 18, No. 1, Jan. 1994, Redhill GB, pp. 11–12, M. Lestani "Temperature control in special steel rod and bar finishing".

*Primary Examiner*—Joseph J. Hail, III
*Assistant Examiner*—Rodney Butler
*Attorney, Agent, or Firm*—Stevens, Davis, Miller & Mosher, LLP

[57] ABSTRACT

A rolling line for long products having a starting nominal transverse dimension between 120 and 180 mm and a final nominal transverse dimension between 4 and 25 mm. The rolling line comprises at least one roughing assembly, an optional reduction and sizing assembly, a fast pre-finishing assembly, and a fast finishing assembly. The optional reduction and sizing assembly having three rolling passes for finishing the long products when their final nominal transverse dimension is in a range between 20 mm and 25 mm. The fast pre-finishing assembly having a plurality of rolling passes, wherein the products are subjected to a same reduction sequence up to the last rolling pass of the plurality of rolling passes. The fast finishing assembly is provided for finishing the long products when their final nominal transverse dimension is lower than 20 mm and has four rolling passes comprised as two separate modules, each having two rolling passes. At least the fast finishing assembly and the reduction and sizing assembly are associated with a changing assembly for quickly changing equipment according to the required reduction of the transverse dimension of the long products. A method for rolling feedstock having a starting nominal transverse dimension between 120 and 180 mm to become long products having a final nominal transverse dimension between 4 and 25 mm. is also provided.

25 Claims, 1 Drawing Sheet

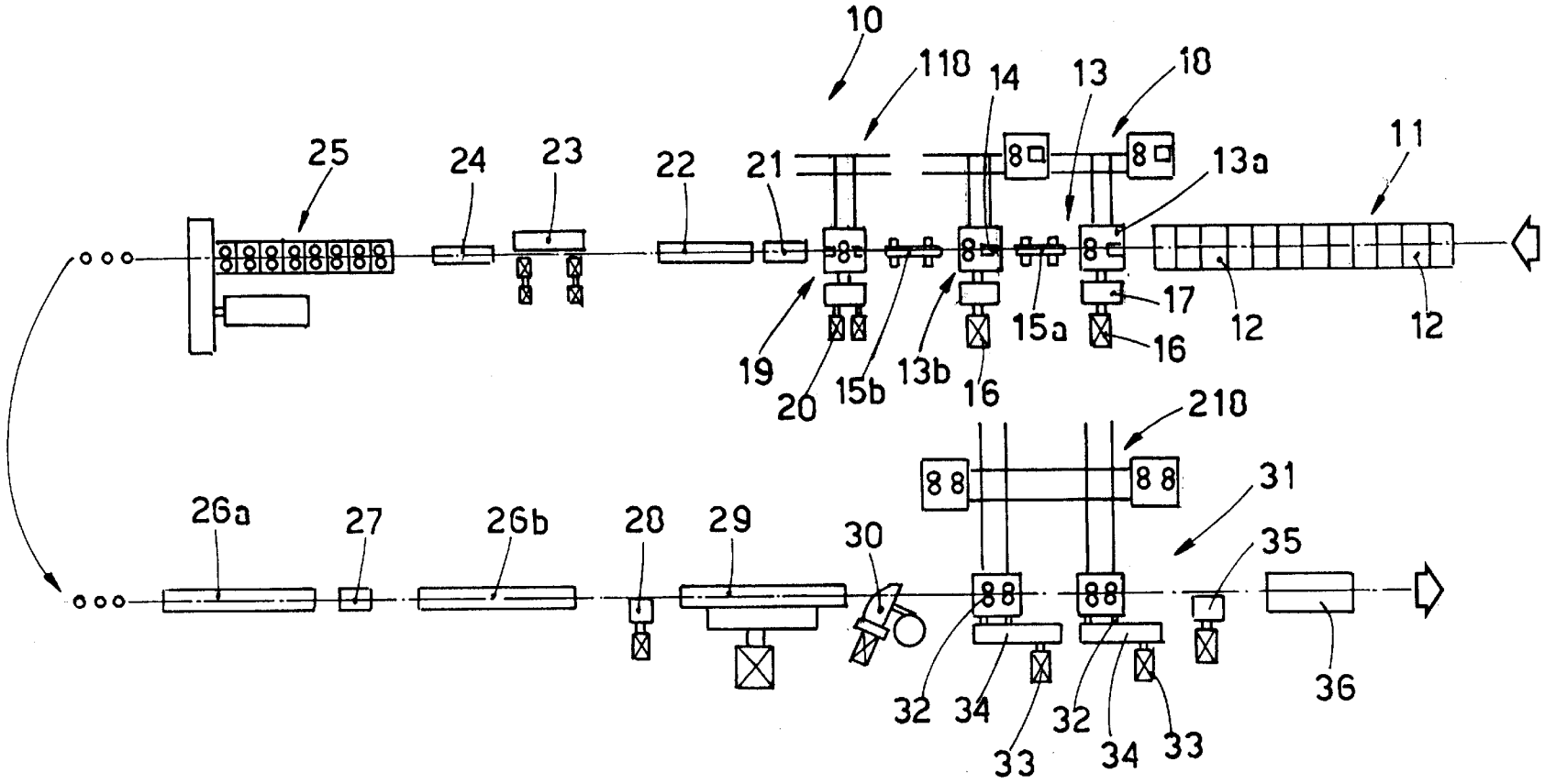
10
110
13
14
13a
13b
15a
15b
16
17
11
12
12
19
20
21
22
23
24
25
210
31
32
32
33
33
34
34
35
36
30
29
28
26b
27
26a

METHOD FOR THE ROLLING OF LONG PRODUCTS AND ROLLING LINE WHICH PERFORMS THAT METHOD

FIELD OF THE INVENTION

This invention concerns an improved method for the rolling of long products and also the rolling line which performs this method, as set forth in the respective main claims.

The invention is applied to the iron and steel production field in the sector of the production of long products consisting of alloys containing iron such as, in particular but not only, bars, rods, wire rods, whether round or of any other required cross-section.

The invention enables the steps of production and particularly the steps of finishing of the product to be improved and makes possible an increase in the output of the plant, an improvement of the surface and inner quality and a reduction of the times for corrective work and maintenance on the line.

BACKGROUND DISCUSSION

In the field of the production by rolling of long products such as bars, rods, wire rods, etc. the great competition between the producers entails more and more the need to meet very strict processing parameters in obtaining products of a high quality at ever lower costs and with ever shorter times.

To be more exact, the requirements of the steelmakers as directed to the designers of plants concern the possibility of meeting the following specifications:

- dimensional tolerances in a range between ±0.08 mm. and ±0.1 mm. over the whole range of dimensions of the rolled product (this range of dimensions in this type of plant being generally between 4.0 and 25 mm.);
- a speed of finishing of the product higher than 120 mts/sec. and even as high as 140 mts/sec.;
- a speed of production of the line at least equal to 120 tons/hr.;
- a percentage of discarded material not greater than 3%;
- a factor of plant usage at least equal to 90%;
- the ability to carry out a finishing process at a low temperature on the whole range of products so as to obtain a high surface and inner quality of the finished product.

All these specifications are not normally met as a whole in the conventional rolling plants, or at least are not met over the whole ranges of products which can be produced by the line.

This situation is due to a plurality of causes which arise mainly from the arrangement of the lay-out of the plant and from the rolling methods conventionally employed, particularly in the change from one dimensional range of products to another.

The rolling method in the conventional plants, which includes a great number of specialised finishing passes for each type of section, entails the necessity of performing frequent and long processes for the change of equipment, and these processes involve long times and the use of labour, thus reducing the factor of exploitation and therefore the efficiency of the plant.

Moreover, in the conventional rolling plants the necessity of performing in separate steps the cropping of the spirals of the leading and trailing ends of the coil entails the use of additional personnel with a resulting increase in costs and in working times for the completion of the process.

Moreover, the conventional rolling method causes the necessity of discarding a great quantity of material, and this situation is now unacceptable in the present rolling plants.

All these problems have induced the present applicants to design a rolling line suitable to meet the above specifications by providing an improved rolling method which improves the characteristics of exploitation and efficiency of the rolling plant, thus achieving a great financial advantage in the production of rolled steels together with quality levels and the ability to repeat those qualities hitherto unattainable in conventional plants.

For this purpose the present applicants have designed, tested and embodied this invention.

This invention is set forth and characterised in the respective main claims, while the dependent claims describe variants of the idea of the main embodiment.

The purpose of the invention is to obtain an improved rolling method and also a rolling line which performs this improved method, the method and the line being such as will optimise the efficiency of a plant performing the rolling of long products, at the same time enabling a product to be made of a high surface and inner quality which is characterised by very small dimensional tolerances.

Another purpose of the invention is to provide an optimised line suitable to work on the whole range of products with shorter and faster operations for the change of equipment, with less use of manual labour and therefore a saving of the labour force and with an improved logistical occupation of space.

BRIEF DESCRIPTION OF THE DRAWINGS

The sole FIGURE shows a preferred lay-out of the rolling line which performs the improved rolling method according to the present invention.

DETAILED DESCRIPTION OF THE PREFERRED EMBODIMENTS

The rolling line according to the invention includes for all the ranges of products the following lay-out of the blocks:

- a roughing assembly normally comprising from 10 to 18 rolling mill stands, depending on the dimension of the starting billet, which is normally between 120 mm. and 180 mm.;
- two pairs of cantilever rolling blocks, each of which comprises two rolling mill stands with alternate horizontal/vertical axes;
- a possible reduction/sizing assembly with three rolling stands;
- a fast pre-finishing block with a number of rolling passes between six and ten;
- a fast finishing assembly with four rolling passes, which comprises two modules, each with two rolling passes.

According to the invention the whole range of dimensions of products between 4.0 mm and 20 mm. follows the same processing line up to the last rolling pass of the pre-finishing block, the changes of product being obtained only in the four rolling passes of the finishing assembly.

The products of the range between 20 mm. and 25 mm. are finished in the reduction/sizing assembly with three rolling passes, and thus the relative changes too are concentrated in this assembly.

The rolling line according to the invention includes an assembly for the fast changing of equipment, this assembly being associated with the two modules of the finishing assembly in the step of the change of product.

This situation enables the times for re-adaptation of the line to be reduced appreciably and reduces the downtimes and thus increases appreciably the factor of exploitation and therefore the output of the plant.

According to a variant, an assembly for the fast changing of equipment is included in cooperation with the pairs of fast-rolling cantilever blocks positioned at the outlet of the roughing assembly.

According to another variant, an assembly for the fast changing of equipment is included also in cooperation with the possible reduction/sizing assembly with three rolling passes located immediately downstream of the fast-rolling cantilever blocks.

This assembly for the fast changing of equipment enables all the three rolling passes or only two rolling passes to be changed at the same time, or else only one pass, depending on the requirements of the rolling sequence.

According to the invention an in-line system of cooling the rolled stock being fed is included at least between the pre-finishing block and the finishing assembly.

This cooling system lowers the temperature of the rolled stock leaving the pre-finishing block and enables a finishing process to be carried out at a low temperature over the whole range of products.

In particular, a bar can be finished at a temperature of about 750° C. or even down to 700° C., and an excellent equalisation of the heat of the bar can be achieved just the same at the inlet of the finishing assembly, owing also to the ample distance provided between the last cooling box and the finishing assembly, this distance being enough to obtain the required degree of stabilisation of the bar in terms of temperature before the final deformation of the bar.

Moreover, since the whole range of dimensions between 4 mm. and 20 mm. is finished in the last four rolling passes downstream of this cooling system, the product being fed passes through the cooling line with a minimum diameter greater than that normally envisaged in conventional rolling trains and at a relatively low temperature.

This condition makes it possible to have a more rigid and stable product travelling through the cooling line and also to keep always functioning the delivery of water in the cooling line, thus enabling the whole product from the leading end to the trailing end of the bar to be cooled in an even and controlled manner.

This situation represents a considerable advantage over the conventional plants in which the diameters of product below 8 mm. are not stable during their travel through the cooling line owing to their modest section, to the high speed and to the high temperature, and therefore the products of conventional plants do not always permit the delivery of water to be kept always working in the cooling line, for such delivery has to be shut off when the leading part of the bar passes through.

This has the effect that the leading part of the bar leaves the cooling line with water at a temperature different from that of the rest of the bar and thus has to be discarded from the coil with a resulting loss of material.

This loss of material is avoided in the system disclosed by our invention, with the resulting advantage of reducing the length of the end segments of the rolled stock not subjected to the cooling treatment and therefore having to be discarded from the coil.

Furthermore, this situation also enables the working life of the valves delivering the cooling water to be prolonged owing to the lesser number of cycles of opening/closing to be carried out over a period of time.

According to the invention a high-speed cropping shears is included upstream of the finishing assembly with the four rolling passes for the purpose of removing automatically the leading and trailing end segments before sending the rolled product to the finishing step.

Thus the high-speed in-line shears makes possible the elimination of the cropping operations conventionally carried out and thus achieves a considerable saving of the labour force employed.

Besides, the wound coil thus produced is ready to be pressed, tied and despatched without undergoing any further manual processing.

According to the invention electronic-control drawing systems are positioned along the line so as to keep the bar always under tension by self-adaptation to any change of section and therefore to any change of the relative speed and tension.

The attached figure is given as a non-restrictive example and shows a preferred lay-out of the rolling line which performs the improved rolling method according to the invention.

A rolling line 10 shown in the attached figure is arranged, as an example, for a billet having an initial square cross-section and sides of about 160 mm. or else a rectangular cross-section which can be likened thereto.

This rolling line 10 comprises in this case a roughing train 11 including twelve rolling mill stands 12 with alternate horizontal/vertical axes, which is followed by two cantilever rolling blocks 13 performing variable reduction, each of which defines two rolling passes 14 having alternate horizontal/vertical axes.

Between the first fast cantilever rolling block 13*a* and the second fast cantilever rolling block 13*b* is positioned a first loop-forming machine 15*a*, which can possibly be disconnected from the line, whereas a second loop-forming machine 15*b*, which too can possibly be disconnected from the line, is included at the outlet of the second fast cantilever rolling block 13*b*.

Each of the cantilever rolling blocks 13 is associated with its own drive motor 16 through a double-ratio gear transmission 17.

The cantilever rolling blocks 13 are associated with a device 18 for the quick change of rolling equipment, by means of which device the whole changing operation can be carried out automatically in a very short time, less than five minutes and probably less than four minutes.

The cantilever rolling blocks 13*a* and 13*b* are perfectly equal to each other and can be interchanged to increase the working flexibility of the rolling line 10.

In this example a reduction/sizing assembly 19 with three rolling passes is included in-line downstream of the second loop-forming machine 15*b* and can possibly be removed from the rolling line 10.

This reduction/sizing assembly 19 with three rolling passes too is associated with its own device 118 for the fast changing of the rolling passes, the device 118 being analogous to the device 18 and having also the purpose of the possible removal of the reduction/sizing assembly 19 from the rolling line 10.

The drive of the reduction/sizing assembly 19 is provided by motors 20.

An assembly 21 to measure dimensions of the product being fed and also to monitor surface faults is included at the outlet of the reduction/sizing assembly 19 and is followed by a first fast cooling assembly 22 employing water.

The product leaving this fast cooling assembly 22 passes through a shears 23 performing cropping of the leading and trailing ends of the product and is then fed into a third loop-forming machine 24, which can possibly be disconnected from the rolling line 10.

The product is then sent to the pre-finishing block 25, which in this case comprises eight reduction rolling passes.

In the method according to the invention the pre-finishing block 25 carries out an average percentage reduction of the cross-section of the rolled product amounting to between about 14% and 20%.

According to the invention, for each range of dimensions of the finished product, for instance between 4.5 mm. and 20 mm., each product follows the same reduction process from its entry into the roughing train 11 up to the last rolling pass of the pre-finishing block 25.

The specific differentiation of each single rolled product is obtained downstream of the pre-finishing block 25.

The rolled product downstream of the pre-finishing block 25 undergoes a fast cooling process, which in this case includes two units 26*a* and 26*b* spraying water.

A device 27 to make the tension of the product uniform is included in this case between the two water spraying units 26*a*, 26*b*.

These water spraying units 26*a*, 26*b* lower the temperature of the product for the purpose of obtaining a finishing process at a low temperature on the whole range of dimensions of the products; this condition enables a better surface and inner quality of the finished product to be achieved and also enables the parameters of tolerance in relation to the established nominal dimension to be improved.

In the water-spraying units 26*a*, 26*b* both the cooling nozzles and the elements which shut-off the water sprayed by those cooling nozzles work at a pressure below 6 bar.

This low pressure enables the initiation of vibrations to be prevented on the point of the bar travelling through the cooling line, and as a result the whole bar from its leading end to its trailing end is evenly cooled.

Downstream of the cooling units 26*a*, 26*b* is positioned an assembly 28 performing drawing with two rolls, at the outlet of which is located in-line a high-speed flying shears 29 which crops the leading and trailing ends of the product and is associated downstream with a scrap shears 30, which breaks up the cropped ends.

In this case, since the product entering the cooling units 26*a*, 26*b* possesses, for each dimension of the finished product, a minimum diameter more than that normally envisaged in the conventional rolling trains and travels at a reasonably low speed, the end segments to be cropped are shorter than those normally envisaged.

The quantities of product discarded are therefore reduced to a value appreciably lower than 3%, which represents a value improved as compared to that which can be achieved in the conventional rolling trains.

Lastly, the product is delivered into the finishing assembly 31.

In this case, the finishing assembly 31 comprises two blocks 32, each of which includes two reduction rolling passes.

In the method according to the invention the two finishing blocks 32 perform a reduction which will vary according to the dimension of the finished product to be achieved and are associated with a third quick-change device 218, which is suitable to perform the changing of the rolling equipment in very short times.

The reduction of section achieved by this finishing assembly 31 is, for all the ranges of dimensions obtainable, at least about 12% to 16%, and this situation enables dimensional tolerances to be achieved which are even smaller than the ±0.1 mm. required by the specifications of the producers.

The inclusion of the quick-change device 218 in association with the finishing assembly 31 enables a quick adaptation of the rolling line 10 to the various ranges of diameters to be achieved and an exploitation of the rolling line 10 to be obtained which is up to at least 94% or even more as compared to values of about 85% to 87% with the conventional rolling lines.

This enables the output of the plant to be increased appreciably and, at the same time, a smaller labour force to be employed in operations on the line 10.

The two finishing blocks 32 are driven individually by respective motors 33, through respective double-ratio gear transmissions 34.

The two motors 33 are coupled to each other by an electric control group governed by the automation system which governs the whole the rolling line 10, the purpose being to be able to adjust extremely accurately the relationship of speed between the two modules having two rolling passes according to the required reduction.

According to a variant, the motor of the pre-finishing block 25 is coupled to the two motors 33 of the finishing assembly 31 by means of an electric control group governed by the automation system of the line 10 so as to be able to adjust accurately the relationship of speed between the pre-finishing block 25 and finishing assembly 31 according to the reduction required.

A drawing assembly 35 with two rolls is included at the outlet of the finishing assembly 31 and sends the product next to the third loop-forming machine 36.

All the drawing assemblies, including at least the drawing assembly 28 and the drawing assembly 35, of the rolling line 10 are equipped with automated adjustment systems governed by the automation system of the line 10, so as to keep the bar under tension between the various assemblies and blocks during every step.

In particular, the drawing assemblies provide a self-adaptation to any variation in the cross-section of the bar during the rolling.

We claim:

1. A method for the rolling of long products having a starting nominal transverse dimension between 120 and 180 mm and a final nominal transverse dimension between 4 and 25 mm, in a rolling line comprising:

at least one roughing assembly (11);

an optional reduction and sizing assembly (19) with three rolling passes;

a fast pre-finishing rolling assembly (25) with a plurality of rolling passes;

a water cooling assembly (26); and a fast finishing rolling assembly (31);

comprising the steps of:

feeding feedstock long products with a starting nominal transverse dimension between 120 and 180 mm to said roughing assembly (11) to produce respective roughing product bars;

feeding said roughing product bars to said optional reduction and sizing assembly (19) only when the final nominal transverse dimension of said long products is comprised in a first range between 20 and 25 mm, to reduce said optionally fed roughing product bars to the desired final nominal transverse dimension without passing through any further rolling assembly, wherein the final sizing of said long products comprised in said first range is obtained in said optional reduction and sizing assembly (19) by passing through said three rolling passes;

feeding said roughing product bars to said fast pre-finishing assembly (25) without passing through said optional reduction and sizing assembly (19), only when the final nominal transverse dimension of said long products is comprised in a second range lower than 20 mm to produce respective fast pre-finishing product bars, wherein each of said roughing product bars in said fast pre-finishing assembly (25) is subjected to a same reduction sequence up to the last rolling pass of said plurality of rolling passes;

passing said fast pre-finishing product bars through said water cooling assembly (26) to reduce the temperature of said fast pre-finishing product bars to about 700° to 750° C., wherein the cooling water in said water cooling assembly (26) is ejected towards said fast pre-finishing product bars at a low pressure of about 6 Bars to prevent the initiation of any vibrations at the ends of the product bars passing through said water cooling assembly (26); and feeding said fast pre-finishing product bars in said fast finishing assembly (31) to produce respective fast finishing long products, wherein the final sizing of said long products comprised in said second range is obtained solely in said fast finishing assembly (31).

2. A method as in claim 1, wherein the distance between the outlet of said water cooling assembly (26) and said first rolling mill stand of said fast finishing assembly (31) is at least such as to make possible a controlled equalisation of heat of the whole fast pre-finishing product bar at the inlet of said fast finishing assembly (31).

3. A method as in claim 1, wherein the speed of finishing of said long products in said fast finishing assembly (31) is about 140 mts/sec.

4. A method as in claim 1, wherein the fast finishing assembly (31) cooperates with a quick-change device (218) to change equipment.

5. A method as in claim 1, wherein said reduction and sizing assembly (19) cooperates with a quick-change device (118) to change equipment, said quick-change device (118) being suitable to change any or all three rolling passes at the same time, according to the requirements of the rolling sequence.

6. A method as in claim 1, wherein said fast finishing assembly (31) comprises two modules connected to two corresponding motors (33) coupled therebetween by an electric control group so as to obtain an accurate adjustment of the relative speeds of said two motors (33) according to the required reduction of the transverse dimension of said long products.

7. A method as in claim 6, wherein said fast pre-finishing assemble (25) is fed by a third motor coupled to said two motors by said electric control group so as to obtain an accurate adjustment of the relative speeds of said three motors according to the required reduction of the transverse dimension of said long products.

8. A method as in claim 1, wherein the delivery of cooling water in said water cooling assembly is always kept in operation due to the high transverse dimension of said fast pre-finishing product bars and the low corresponding speed thereof through said water cooling assembly.

9. A method as in claim 1, wherein upstream of said fast finishing assembly (31) both leading and trailing ends of said fast pre-finishing product bars are sheared by flying shears (29).

10. A method as in claim 1, wherein the speed of finishing of any long products in said fast finishing assembly (31) is about 140 mts/sec.

11. A method as in claim 1, wherein said fast finishing assembly (31) cooperates with a quick-change device (218) to change equipment.

12. As method as in claim 1, wherein the rolling line comprises said reduction and sizing assembly and said reduction and sizing assembly is removable.

13. A method as in claim 1, wherein the rolling line comprises said reduction and sizing assembly, wherein said reduction and sizing assembly is removably aligned with said roughing assembly and said fast pre-finishing rolling assembly (25) is removably alignable with said roughing assembly, wherein at most one member of the group consisting of said reduction and sizing assembly and said fast pre-finishing rolling assembly 25 is aligned to be fed roughing product bars by said roughing assembly at any given time.

14. A method as in claim 1, wherein the rolling line comprises two pairs of cantilever rolling blocks (13) with rolling stands having alternate horizontal-vertical axes.

15. A rolling line for long products having a starting nominal transverse dimension between 120 and 180 mm and a final nominal transverse dimension between 4 and 25 mm, comprising:

at least one roughing assembly (11);

an optional reduction and sizing assembly (19) with three rolling passes for finishing said long products when their final nominal transverse dimension is in a range between 20 mm and 25 mm;

a fast pre-finishing assembly (25) having a plurality of rolling passes, wherein said products are subjected to a same reduction sequence up to the last rolling pass of said plurality of rolling passes; and a fast finishing assembly (31) for finishing said long products when their final nominal transverse dimension is lower than 20 mm, said fast finishing assembly (31) having four rolling passes, wherein said fast finishing assembly comprises two separate modules, each having two said rolling passes, wherein at least said fast finishing assembly (31) and said reduction and sizing assembly (19) is associated with a changing assembly (218, 118) performing the fast change of equipment according to the required reduction of the transverse dimension of said long products.

16. A rolling line as in claim 15, wherein between said fast pre-finishing assembly (25) and said fast finishing assembly (31) water-spraying cooling units (26*a*, 26*b*) are deposed, equipped with cooling elements and with elements to shut-off the water thus sprayed, said cooling elements and water-shut-off elements working at a pressure of about 6 Bars.

17. A rolling line as in claim 15, wherein a high-speed flying shears (29) to crop the leading and trailing ends of said long products is provided upstream of said fast finishing assembly (31).

18. A rolling line as in claim 15, wherein an assembly (21) to measure the dimensions of any long products is provided at the outlet of said reduction and sizing assembly (19).

19. A rolling line as in claim 15, wherein each block (32) of said fast finishing assembly (31) is associated with its own motor (33).

20. A rolling line as in claim 15, further comprising drawing assemblies (28, 35) equipped with automated adjustment systems to keep any long products under tension between said assemblies, with self-adaptation to every variation of transverse dimension of any long products during the rolling.

21. A rolling line as in claim 15, wherein the rolling line comprises said reduction and sizing assembly and said reduction and sizing assembly is removable.

22. A rolling line as in claim 15, wherein the rolling line comprises said reduction and sizing assembly, wherein said reduction and sizing assembly is removably alignable with said roughing assembly and said fast pre-finishing rolling assembly (25) is removably alignable with said roughing assembly, wherein at most one member of the group consisting of said reduction and sizing assembly and said fast pre-finishing rolling assembly 25 is aligned to be fed long products by said roughing assembly at any given time.

23. A rolling line as in claim 15, further comprising two pairs of cantilever rolling blocks (13) with rolling stands having alternate horizontal-vertical axes.

24. A rolling line as in claim 16, wherein a device (27) to make uniform the tension of any long products passing through the line is provided between said two water-spraying cooling units **(26*a*, 26*b*)**.

25. A rolling line as in claim 19, wherein said motors (33) are coupled by an electric control group.

* * * * *